US005592718A

United States Patent [19]

Mohr

[11] Patent Number: 5,592,718

[45] Date of Patent: Jan. 14, 1997

[54] BELT BUCKLE ALIGNMENT DEVICE

[76] Inventor: Donald C. Mohr, 353 G Lexington Ct., Pewaukee, Wis. 53072

[21] Appl. No.: 369,156

[22] Filed: Jan. 5, 1995

[51] Int. Cl.[6] ..... A44B 11/22

[52] U.S. Cl. ..... 24/265 BC; 24/265 R

[58] Field of Search ..... 24/265 R, 265 H, 24/265 EC, 265 BC, 265 AL, 481, 482

[56] References Cited

U.S. PATENT DOCUMENTS

| | | | |
|---|---|---|---|
| 1,833,175 | 11/1931 | Pollock | 24/265 BC |
| 5,305,540 | 4/1994 | Blenk | 24/265 R X |

FOREIGN PATENT DOCUMENTS

| | | | |
|---|---|---|---|
| 228521 | 11/1910 | Germany | 24/265 BC |
| 2739197 | 3/1979 | Germany | 24/265 R |

*Primary Examiner*—James R. Brittain

*Attorney, Agent, or Firm*—DeWitt M. Morgan; Kevin L. Wildenstein

[57] ABSTRACT

An alignment device for centering an end of a belt relative to a U-shaped mount of a belt buckle. The inventive device includes a folded web positionable about the U-shaped mount and including upper and lower spacing webs extending between the belt and respectively opposed upper and lower portions of the U-shaped mount to center the belt relative thereto so as to preclude tilting of the belt buckle relative to the belt.

4 Claims, 4 Drawing Sheets

PRIOR ART

BELT BUCKLE ALIGNMENT DEVICE

BACKGROUND OF THE INVENTION

1. Field of the Invention

The present invention relates to spacing devices and more particularly pertains to an belt buckle alignment device for centering an end of a belt relative to a U-shaped mount of a belt buckle.

2. Description of the Prior Art

The use of spacing devices is known in the prior art. More specifically, spacing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art spacing devices include U.S. Pat. No. 5,285,555; U.S. Pat. No. 5,243,741; U.S. Pat. No. 4,733,440; U.S. Pat. No. 4,593,439; U.S. Pat. No. 3,977,049; and U.S. Design Pat. No. 340,679.

While these devices fulfill their respective, particular objectives and requirements, the aforementioned patents do not disclose a belt buckle alignment device for centering an end of a belt relative to a belt buckle which includes a folded web positionable about the U-shaped mount of the belt buckle and including upper and lower spacing webs extending between the belt and respectively opposed upper and lower portions of the U-shaped mount to center the belt buckle relative thereto.

In these respects, the belt buckle alignment device according to the present invention substantially departs from the conventional concepts and designs of the prior art, and in so doing provides an apparatus primarily developed for the purpose of centering an end of a belt relative to a U-shaped mount of a belt buckle.

SUMMARY OF THE INVENTION

In view of the foregoing disadvantages inherent in the known types of spacing devices now present in the prior art, the present invention provides a new belt buckle alignment device construction wherein the same can be utilized for centering an end of a belt relative to a belt buckle to preclude tilting of the buckle relative to the belt. As such, the general purpose of the present invention, which will be described subsequently in greater detail, is to provide a new belt buckle alignment device apparatus and method which has many of the advantages of the spacing devices mentioned heretofore and many novel features that result in a belt buckle alignment device which is not anticipated, rendered obvious, suggested, or even implied by any of the prior art spacing devices, either alone or in any combination thereof.

To attain this, the present invention generally comprises an alignment device for centering and end of a belt relative to a U-shaped mount of a belt buckle. The inventive device includes a folded web positionable about the U-shaped mount and including upper and lower spacing webs extending between the belt and respectively opposed upper and lower portions of the U-shaped mount to center the belt relative thereto so as to preclude tilting of the belt buckle relative to the belt.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new belt buckle alignment device apparatus and method which has many of the advantages of the spacing devices mentioned heretofore and many novel features that result in a belt buckle alignment device which is not anticipated, rendered obvious, suggested, or even implied by any of the prior art spacing devices, either alone or in any combination thereof.

It is another object of the present invention to provide a new belt buckle alignment device which may be easily and efficiently manufactured and marketed.

It is a further object of the present invention to provide a new belt buckle alignment device which is of a durable and reliable construction.

An even further object of the present invention is to provide a new belt buckle alignment device which is susceptible of a low cost of manufacture with regard to both materials and labor, and which accordingly is then susceptible of low prices of sale to the consuming public, thereby making such belt buckle alignment devices economically available to the buying public.

Still yet another object of the present invention is to provide a new belt buckle alignment device which provides in the apparatuses and methods of the prior art some of the advantages thereof, while simultaneously overcoming some of the disadvantages normally associated therewith.

Still another object of the present invention is to provide a new belt buckle alignment device for centering an end of a belt relative to a U-shaped mount of a belt buckle to preclude tilting of the belt buckle relative to the belt.

Yet another object of the present invention is to provide a new belt buckle alignment device which includes a folded web positionable about the U-shaped mount of the belt buckle and including upper and lower spacing webs extending between the belt and respectively opposed upper and lower portions of the U-shaped mount to center the belt buckle relative thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
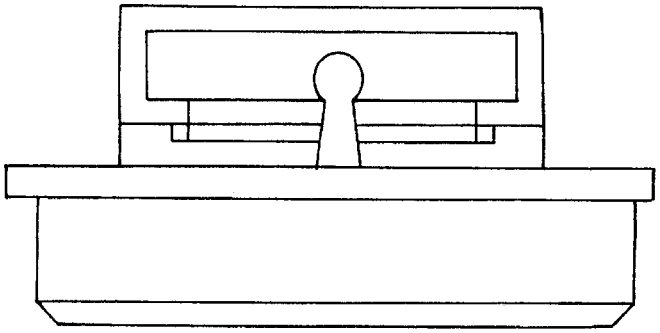
FIG. 1 is an elevation view of a prior art belt buckle.

With reference now to the drawings, and in particular to FIGS. 3–8 thereof, a new belt buckle alignment device embodying the principles and concepts of the present invention and generally designated by the reference numeral 10 will be described.

Figure 2:
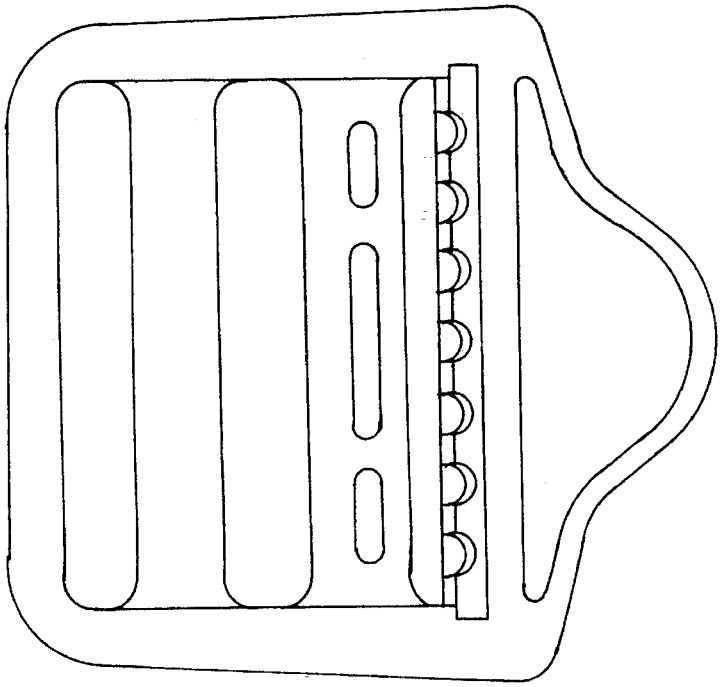
PRIOR ART Fig. 2
FIG. 2 is a plan view of a further prior art belt buckle.
Figure 3:
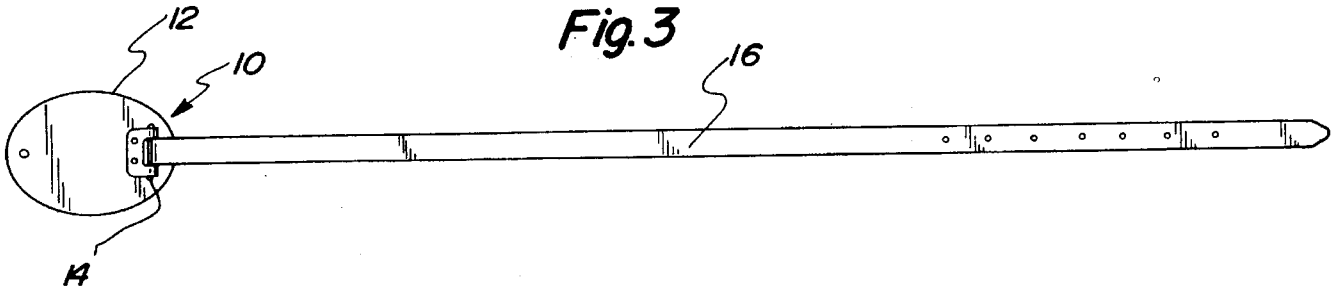
FIG. 3 is an elevation view of a belt buckle alignment device according to the present invention in use.

Turning initially to FIGS. 1 and 2 wherein prior art belt buckles are illustrated, it can be shown that the prior art teaches belt buckles each having a U-shaped mount for receiving and engaging a belt of a particular transverse width.

Figure 4:
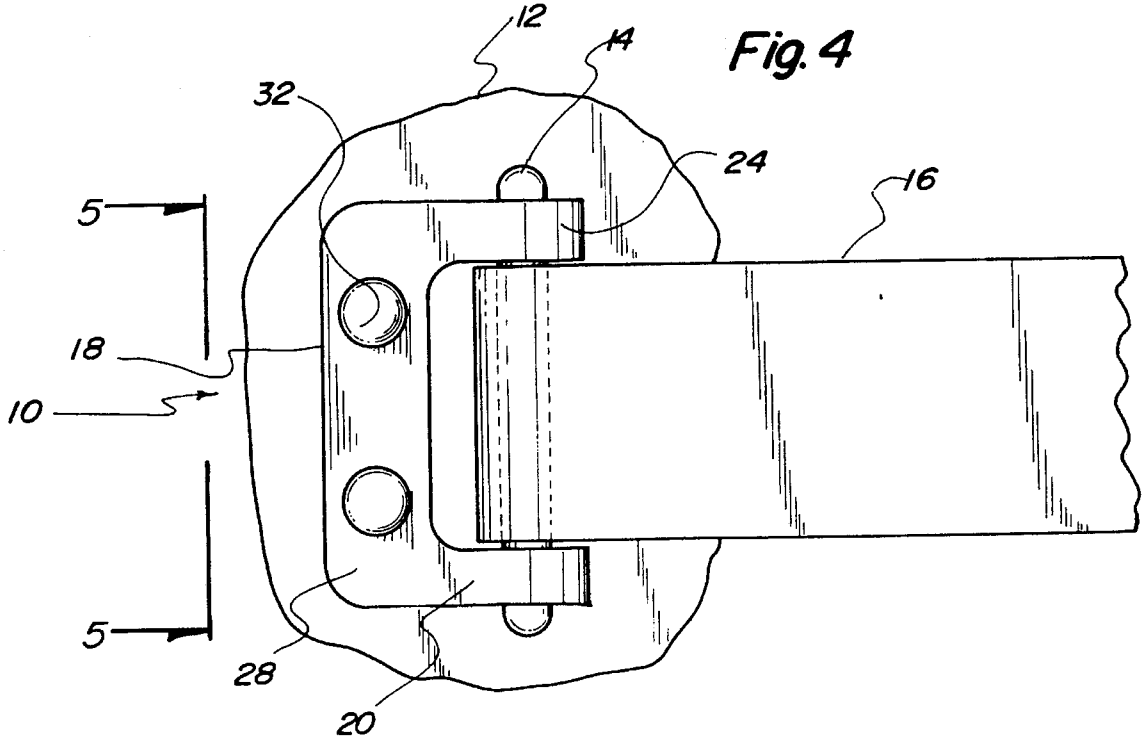
FIG. 4 is an enlarged elevation view of the invention in use.
Figure 5:
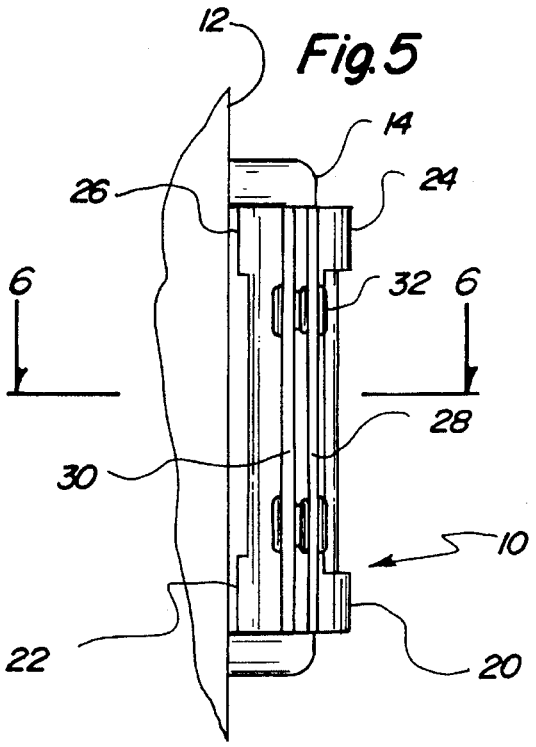
FIG. 5 is an end elevation view taken along line 5—5 of FIG. 4.
Figure 6:
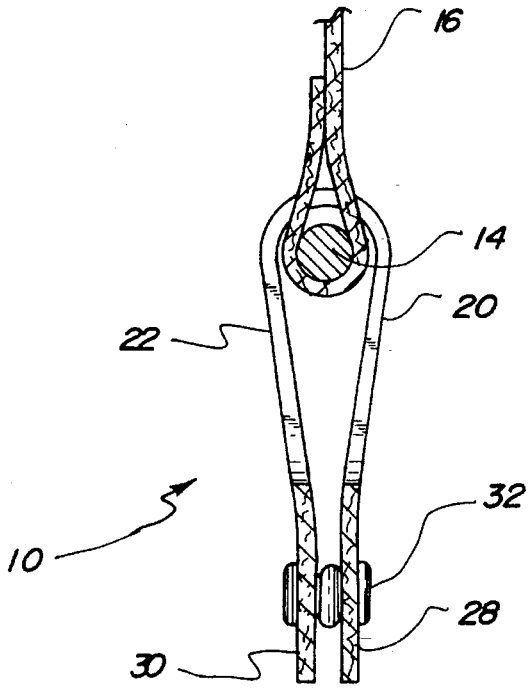
FIG. 6 is a cross-sectional view taken along line 6—6 of FIG. 5.
Figure 7:
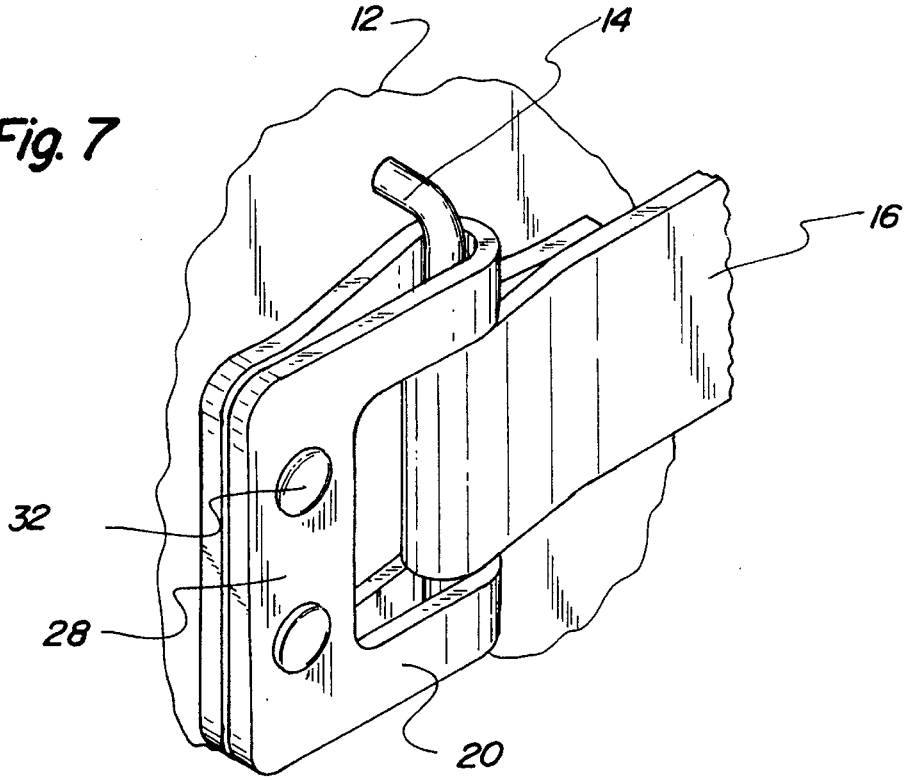
FIG. 7 is an isometric illustration of the belt buckle alignment device as installed to a belt buckle.

Turning now to FIGS. 3 through 8 wherein the present invention is illustrated in detail, it can be shown that the belt buckle alignment device 10 is configured for use with a belt buckle 12 having a U-shaped mount 14 of a first transverse dimension, with a belt 16 of a second transverse dimension substantially less than the first transverse dimension of the U-shaped mount 14 and coupled to the U-shaped mount substantially as shown. The belt buckle alignment device 10, as shown in FIG. 4 is operable to be engaged to the U-shaped mount 14 to substantially center the belt 16 relative to the mount. To this end, the belt buckle alignment device 10 comprises a folded web 18 including a pair of upper spacing webs and a pair of lower spacing webs which extend between the belt and respectively opposed upper and lower portions of the U-shaped mount 14.

As best illustrated in FIGS. 5 through 8, it can be shown that the folded web 18 is shaped so as to define an outer lower spacing web 20 extendable about a lower portion of the U-shaped mount 14 to define an inner lower spacing web 22. Similarly, an outer upper spacing web 24 extends about an upper portion of the U-shaped mount 14 and continues into an inner upper spacing web 26. The outer lower spacing web 20 is spaced from and oriented so as to extend substantially parallel relative to the outer upper spacing web 24, with an outer securing web 28 extending therebetween. Similarly, the inner lower spacing web 22 spaced from and oriented so as to extend substantially parallel to the inner upper spacing web 26, with an inner securing web 30 extending therebetween. By this structure, the belt 16 can be positioned between the lower spacing webs 20, 22 and the upper spacing webs 24, 26, with the inner securing web 30 being positioned through the U-shaped mount 14 of the belt buckle 12. The outer securing web 28 can then be secured to the inner securing web 30 by at least one securing snap 32. Alternatively, velcro or other similar fastening means can be utilized to removably couple the securing webs 28 and 30 together.

Figure 8:
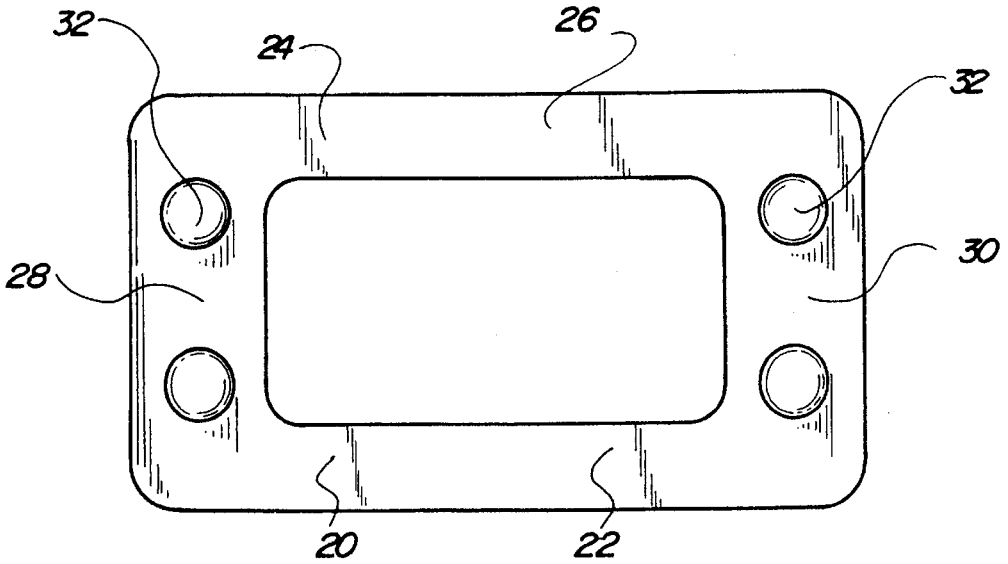
FIG. 8 is a plan view of the invention in an unfolded condition.

As shown in FIG. 8, the folded web 18 of the present invention 10 can be formed as a substantially rectangular blank having a substantially rectangular aperture extending therethrough so as to define the webs 20–30 thereof.

In use, the belt buckle alignment device according to the present invention can be easily coupled to a belt buckle 12 and belt 16 combination so as to substantially center the belt 16 relative to the U-shaped mount 14 of the belt buckle to preclude tilting of the belt buckle relative to the belt 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An alignment device for use with a belt buckle having a U-shaped mount of a first transverse dimension and having opposed upper and lower portions, and for use with a belt of a second transverse dimension substantially less than the first transverse dimension of the U-shaped mount, the alignment device being couplable to the U-shaped mount to substantially center the belt on the U-shaped mount, the alignment device comprising:

(a) a foldable web including a pair of upper spacing webs of a third transverse dimension and a pair of lower spacing webs of a fourth transverse dimension which are extendable between the belt and the respectively opposed upper and lower portions of the U-shaped mount, the sum of the second transverse dimension, the third transverse dimension and the fourth transverse dimension being substantially equal to the first transverse dimension;

(b) securing web portions interposed between the lower spacing webs and the upper spacing webs, and (c) a plurality of securing snaps coupled to the securing web portions for joining the securing web portions together about the U-shaped mount, the securing snaps positioned transverse to the upper spacing webs and the lower spacing webs, to substantially center the belt relative to the U-shaped mount of the belt buckle.

2. The belt buckle alignment device of claim 1, wherein the folded web is shaped so as to define an outer lower spacing web extendable about a lower portion of the U-shaped mount which continues into the inner lower spacing web; and an outer upper spacing web extendable about an upper portion of the U-shaped mount which continues into the inner upper spacing web, the lower spacing webs being spaced from and oriented so as to extend substantially parallel relative to the upper spacing webs; the securing web portion including an outer securing web extending between the outer lower spacing web and the outer upper spacing web; and an inner securing web extending between the inner lower spacing web and the inner upper spacing web.

3. The belt buckle alignment device according to claim 1 wherein the third transverse dimension is substantially equal to the fourth transverse dimension.

4. A device adapted to prevent tilting of a belt buckle when attached to a belt having a second transverse dimension, comprising:

(a) the belt buckle, the belt buckle including a U-shaped mount of a first transverse dimension, the U-shaped mount further having an upper portion and an opposed lower portion; and (b) an alignment device, the alignment device comprising a web having a pair of upper spacing webs of a third transverse dimension and a pair of lower spacing webs of a fourth transverse dimension which are extendable between the belt and the respectively opposed upper and lower portions of the U-shaped mount, the upper spacing webs and lower spacing webs foldable upon the opposed upper and lower portions of the U-shaped mount, the sum of the third and fourth transverse dimensions being less than the first transverse dimension by an amount substantially equal to the second transverse dimension.

* * * * *